US005186344A

United States Patent [19]

Cook

[11] Patent Number: 5,186,344

[45] Date of Patent: * Feb. 16, 1993

[54] CONTAINER AND CLOSURE HAVING MEANS FOR PRODUCING AN AUDIBLE SIGNAL WHEN A SEAL HAS BEEN ESTABLISHED

[75] Inventor: Charles D. Cook, Fairfield, Ohio

[73] Assignee: The Procter & Gamble Company, Cincinnati, Ohio

[ * ] Notice: The portion of the term of this patent subsequent to Oct. 30, 2007 has been disclaimed.

[21] Appl. No.: 591,650

[22] Filed: Oct. 2, 1990

[51] Int. Cl.[5] ..... B65D 41/04

[52] U.S. Cl. ..... 215/330; 215/331; 215/341

[58] Field of Search ..... 215/329, 330, 331, 213, 215/216, 217, 218, 221, 232, 341; 220/89.1, 256, 366

[56] References Cited

U.S. PATENT DOCUMENTS

| | | | |
|---|---|---|---|
| Re. 27,673 | 6/1973 | Landen . | |
| Re. 29,793 | 10/1978 | Pehr . | |
| 2,061,214 | 11/1936 | Sentman . | |
| 2,072,873 | 3/1937 | Fusting et al. | 215/331 |
| 2,847,139 | 8/1958 | Christiansson et al. . | |
| 2,964,207 | 12/1960 | Towns . | |
| 3,019,931 | 2/1962 | Thornton . | |
| 3,101,856 | 8/1963 | Whiteman, Jr. . | |
| 3,110,411 | 11/1963 | Golde . | |
| 3,185,333 | 5/1965 | Sharp . | |
| 3,200,979 | 8/1965 | Powers . | |
| 3,233,769 | 2/1966 | Jessop . | |
| 3,306,482 | 2/1967 | Tuuri . | |
| 3,373,888 | 3/1968 | Fuller | 215/331 X |
| 3,394,829 | 7/1968 | Peterson . | |
| 3,399,796 | 9/1968 | Steiner . | |
| 3,445,022 | 5/1969 | Cilluffo . | |
| 3,472,409 | 10/1969 | Slack et al. . | |
| 3,531,008 | 9/1970 | Achabal et al. . | |
| 3,563,368 | 2/1971 | McHugh . | |
| 3,567,057 | 3/1971 | Landen . | |
| 3,593,879 | 7/1971 | Gach . | |
| 3,627,160 | 12/1971 | Horvath . | |
| 3,667,637 | 6/1972 | Bagguley et al. . | |
| 3,700,133 | 10/1972 | Bagguley . | |
| 3,744,655 | 7/1973 | Nixdorff, Jr. . | |
| 3,757,979 | 9/1973 | Berghahn . | |

(List continued on next page.)

FOREIGN PATENT DOCUMENTS

| | | | |
|---|---|---|---|
| 109493 | 10/1967 | Denmark | 215/331 |
| 2570057 | 3/1986 | France . | |
| 455545 | 3/1968 | Switzerland | 215/330 |

*Primary Examiner*—Allan N. Shoap
*Assistant Examiner*—Stephen Cronin
*Attorney, Agent, or Firm*—E. Kelly Linman; Thomas H. O'Flaherty

[57] ABSTRACT

A package having means for producing an audible signal, such as a "click", which signals the consumer as soon as a predetermined level of engagement between a container and a closure has been achieved. Normally the desired level of engagement establishes some type of seal between the package components which contact one another. In a particularly preferred embodiment, a semi-rigid polymeric container having a discharge orifice, a sealing member preferably comprising a filter support member secured across the discharge orifice of the container and a closure having attachment means capable of forming a substantially gas-tight atmospheric seal between all three components upon initial closing of the package to the atmosphere is provided. The container and closure are further provided with interfering projections, at least one of which is resiliently deformable, which will contact one another only after the sealing member has been removed from the package and discarded and the closure reapplied to the container. These projections are so positioned relative to the sealing surfaces on the closure and container that the projections cannot interfere with one another until after the closure and container have achieved the desired level of engagement with one another. In a particularly preferred embodiment, means to prevent overtorquing of the closure onto the container after the audible signal has been sounded are also provided.

8 Claims, 9 Drawing Sheets

U.S. PATENT DOCUMENTS 3,773,203 11/1973 Grimaldi et al. .
3,777,924 12/1973 Kayser et al. .
3,794,200 2/1974 Marks .
3,794,201 2/1974 Galer .
3,811,589 5/1974 Thornton et al. .
3,826,394 7/1974 Stull .
3,830,392 8/1974 Kessler et al. .
3,848,780 11/1974 Stull .
3,865,267 2/1975 Morris .
3,870,182 3/1975 Georgi .
3,877,597 4/1975 Montgomery et al. .
3,881,625 5/1975 Landen .
3,884,379 5/1975 Laden .
3,891,110 6/1975 Gach .
3,892,326 7/1975 Schneible .
3,894,647 7/1975 Montgomery .
3,895,730 7/1975 Koehne et al. .
3,900,123 8/1975 Darlington .
3,901,400 8/1975 Westfall .
3,902,620 9/1975 McIntosh .
3,917,097 11/1975 Uhlig .
3,954,200 5/1976 Willis .
3,968,871 7/1976 Briscoe .
3,989,152 11/1976 Julian .
3,993,208 11/1976 Ostrowsky .
3,993,209 11/1976 Julian .
4,002,259 1/1977 Geiser .
4,036,385 7/1977 Morris .
4,051,972 10/1977 Botkin ..... 215/260
4,061,239 12/1977 Tasseron .
4,093,096 6/1978 Augros ..... 215/330
4,099,639 7/1978 Boxer et al. .
4,103,797 8/1978 Morris .
4,106,654 8/1978 Jones .
4,138,028 2/1979 Price et al. .
4,141,461 2/1979 LaChance .
4,144,983 3/1979 Pauls et al. .
4,149,646 4/1979 Julian .
4,154,353 5/1979 Hoo .
4,204,615 5/1980 McCarthy .
4,223,794 9/1980 Morris .
4,261,478 4/1981 Summers .
4,271,974 6/1981 Quinard ..... 215/331
4,273,248 6/1981 Lehmann ..... 215/331
4,285,437 8/1981 Morris .
4,289,248 9/1981 Lynn .
4,310,101 1/1982 Sekine ..... 215/330
4,331,247 5/1982 Mumford .
4,335,823 6/1982 Montgomery et al. .
4,337,869 7/1982 Guinle .
4,353,473 10/1982 Morris .
4,509,653 4/1985 Corbett ..... 215/231
4,520,921 6/1985 Vissing .
4,526,289 7/1985 Schiemann ..... 220/304
4,531,649 7/1985 Shull ..... 215/232
4,597,501 7/1986 Gueret ..... 215/330
4,662,530 5/1987 Goncalves et al. ..... 215/330
4,690,292 9/1987 Henning .
4,691,833 9/1987 Ahrens ..... 215/227
4,733,786 3/1988 Emslander ..... 215/230
4,767,016 8/1988 Cook, Jr. et al. ..... 215/230
4,782,965 11/1988 Wassilieff .
4,782,966 11/1988 Thackrey .
4,832,220 5/1989 Quennessen ..... 215/331
4,858,776 8/1989 Mehra ..... 215/270
4,889,238 12/1989 Batchelor .
4,966,780 10/1990 Hargraves et al. .

CONTAINER AND CLOSURE HAVING MEANS FOR PRODUCING AN AUDIBLE SIGNAL WHEN A SEAL HAS BEEN ESTABLISHED

TECHNICAL FIELD

The present invention has relation to a package comprised of at least two mating components having means for producing an audible signal to let the consumer know when a seal has been established between the components.

The present invention has further relation to such a package comprising a container and a closure, said package further including means to prevent overtorquing of said closure onto said container after said audible signal has been sounded.

The present invention, in a particularly preferred embodiment, has further relation to the packaging of fresh roasted coffee in a manner that will more effectively preserve its aroma and freshness throughout the package's useful life.

The present invention has further relation to such a package of fresh roasted coffee which is easy to use and which can be effectively and reliably resealed by the consumer after initial opening without the need to overtorque the closure onto the container.

BACKGROUND ART

The packaging of fresh roasted coffee exhibiting improved aroma retention and freshness throughout the package's useful life is disclosed in commonly assigned allowed U.S. patent application Ser. No. 07/358,927 filed on May 26, 1989 in the names of Peter J. Hargraves, Robert S. Dirksing and Theodore P. Merz, now U.S. Pat. No. 4,966,780 issued on Oct. 30, 1990, the disclosure of said Application being hereby incorporated herein by reference.

The aforementioned commonly assigned U.S. patent application, now U.S. Pat. No. 4,966,780, teaches the packaging of roasted coffee as quickly as feasible after the roasting process has been performed in a semi-rigid, substantially gas-impervious polymeric container capable of withstanding the pressure generated by the release of carbon dioxide and other gases from the fresh roasted coffee in the container. A porous filter member is preferably secured across the discharge orifice of the container to prevent coffee from aspirating from the container when the pressurized package is initially opened by the consumer. The filter is normally removed and discarded after initial opening of the package.

The semi-rigid container employs resealable closure means which are capable of:

1. Providing a substantially gas-tight seal to the atmosphere prior to initial opening by the consumer; and 2. Establishing a reseal which is effective to resist ambient atmospheric pressure changes.

As used both herein and in the aforementioned commonly assigned U.S. patent application, now U.S. Pat. No. 4,966,780, a reseal which is "effective to substantially resist ambient atmospheric pressure changes" is defined as one which will produce an oxygen content in the package of roasted coffee which is at least about ten (10) percent lower than the oxygen content of the surrounding ambient atmosphere, as measured two days after the package has been initially opened, the closure member and filter removed for a period of about thirty seconds without removing any coffee from the package, and only the closure member thereafter snugly reapplied. The establishment of such an effective reseal minimizes the ingress of atmospheric oxygen into the package of roasted coffee intermediate dispensing cycles after the package has been initially opened.

In a particularly preferred embodiment of the package disclosed in the aforementioned commonly assigned U.S. patent application, now U.S. Pat. No. 4,966,780, the filter used to prevent aspiration of the pressurized coffee from the discharge orifice of the container upon initial opening by the consumer comprises a porous filter secured by a filter support member across the discharge orifice of the container. The substantially gas-tight seal to the atmosphere is initially established in the package by means of the opposed surfaces of the filter support member. One surface of the filter support member establishes a seal with the discharge orifice of the container while the opposed surface of the filter support member establishes a seal with the innermost surface of the closure.

The means for securing the resealable closure onto the semi-rigid container preferably comprises complementary thread sets which include at least one gas vent to permit escape of the pressurized gas from the interior of the container before the threads become completely disengaged from one another. This prevents missiling of the closure from the container upon initial opening of the pressurized package.

Upon initial opening of the package, the filter support member and filter are normally removed and discarded so the reseal which is to be effective in resisting ambient atmospheric pressure changes must thereafter be established directly between the innermost surface of the closure and the discharge orifice of the container.

While the magnitude of the torque which must be applied to establish such a reseal directly between the closure and the container will normally depend upon such factors as the discharge orifice and closure configuration as well as their materials of construction, establishment of a reseal which is effective to substantially resist ambient atmospheric pressure changes can normally be made more certain by tightening the closure as far as the consumer's strength will permit. However, it is normally not necessary to retighten the closure as far as the consumer's strength will permit in order to establish a reseal which is effective to substantially resist ambient atmospheric pressure changes. Furthermore, such extreme retightening of the closure by one user may make it all but impossible for the next user in the same household to remove the closure and dispense product from the container, particularly if the second user is of lesser strength than the first user. Such disparities in strength are common among different members of a single household, all of whom are likely to use the same package.

OBJECTS OF THE PRESENT INVENTION

Accordingly, it is an object of the present invention to provide a package having means for producing an audible signal, such as a "click", which signals the consumer as soon as a reseal which will be effective to substantially resist ambient atmospheric pressure changes has been achieved between the container and closure.

It is another object of the present invention to provide means to prevent overtorquing of the closure onto the container after the audible signal has been sounded.

DISCLOSURE OF THE INVENTION

The present invention comprises, in a particularly preferred embodiment, a semi-rigid polymeric container having a discharge orifice, a sealing member preferably comprising a filter support member secured across the discharge orifice of the container and a closure having attachment means capable of forming a substantially gas-tight atmospheric seal between all three components upon initial closing of the package to the atmosphere.

The container and closure are further provided with interfering projections, at least one of which is resiliently deformable, which will contact one another only after the sealing member has been removed from the package and discarded and the closure reapplied to the container. These projections are so positioned relative to the sealing surfaces on the closure and container that the projections cannot interfere with one another until after the closure and container have formed a reseal which will be effective to substantially resist ambient atmospheric pressure changes.

The interfering resiliently deformable projection on one component provides an audible "click" as soon as it passes the interfering substantially non-deformable projection on the mating component. This signals the user that a reseal which will be effective to substantially resist ambient atmospheric pressure changes has been established between the closure and the container. Further tightening of the closure onto the container is unnecessary to provide the enhanced coffee aroma retention and freshness benefits described in commonly assigned allowed U.S. patent application Ser. No. 07/358,927, now U.S. Pat. No. 4,966,780, which is incorporated herein by reference.

In a particularly preferred embodiment, a second set of substantially non-deformable interfering projections are also provided on the interior of the closure and the exterior of the container. These latter interfering projections are so positioned relative to the first set of interfering projections that they will prevent further advancement of the closure onto the container shortly after the audible "click" has been produced by passage of the first set of interfering projections on the closure and container past one another. The second set of substantially non-deformable projections prevent overtorquing of the closure onto the container once contact is established between them, thereby making subsequent removal of the closure easier for subsequent users of the package.

The present invention may also be practiced to advantage in those situations where there is no requirement for two different levels of sealing at different points in the package's useful life. In such instances the independent sealing member between the container and closure may be made of such a thin membrane that its removal has little or no effect on the seal established between the closure and the container, or if the membrane is not needed for other purposes such as supporting a porous filter or providing evidence of tampering, it may be eliminated altogether. In either of the aforementioned cases, the torque limiting projections are preferably positioned so as to control both the initial torque applied by the manufacturer and the reapplication torque applied by the end user. In the latter circumstance, the audible "click" will of course be triggered not only by the initial application of the closure to the container, but by any subsequent reapplications as well.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE PRESENT INVENTION

Figure 1:
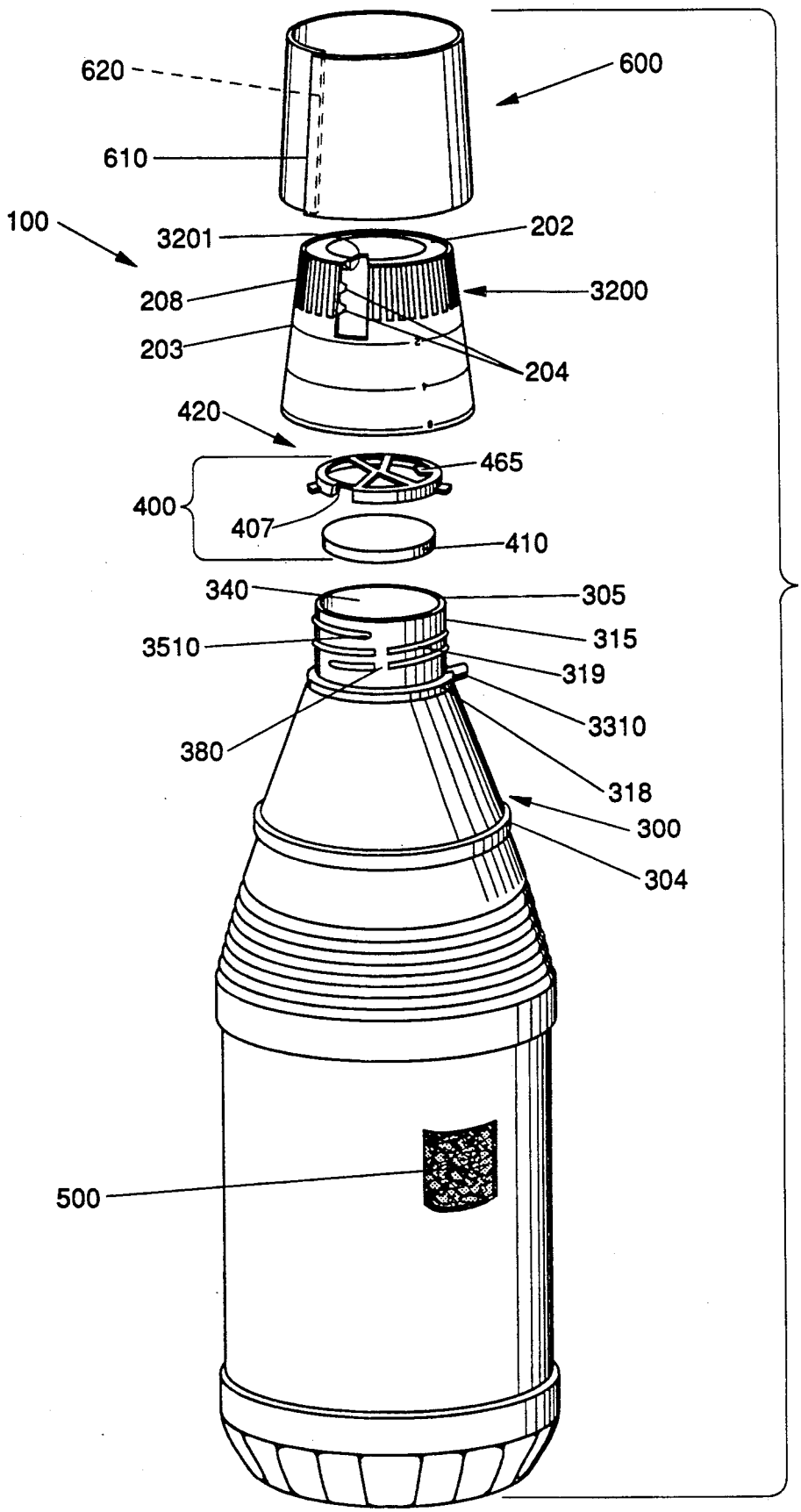
FIG. 1 is an exploded perspective view of a particularly preferred roasted coffee package of the present invention.

FIG. 1 discloses a particularly preferred execution of a semi-rigid, substantially gas-impervious roasted and ground coffee package 100 of the present invention with the various components comprising the preferred package shown in an exploded relationship. In the illustrated embodiment the roasted and ground coffee package 100 comprises a semi-rigid container 300 preferably comprised of a moldable polymeric material, a resealable closure 3200 and a filter means 400 to prevent aspiration of the freshly roasted and ground coffee product 500 from the container upon initial opening of the package by the consumer. A tamper evident shrink band 600 is preferably applied over the closure and shrunk in place to lock the closure to the finger support bead 304 on the container 300.

The various components comprising the preferred package 100 are described in great detail in allowed commonly assigned U.S. patent application Serial No. 07/358,927 filed on May 26, 1989 in the names of Peter J. Hargraves, Robert S. Dirksing and Theodore P. Merz, now U.S. pat. No. 4,966,780, the disclosure of which is incorporated herein by reference. However, the components which are critical to the practice of the present invention are hereinafter described in sufficient detail to enable a person of ordinary skill in the art to beneficially practice the present invention in a wide range of packaging applications where it is desirable to provide an audible signal to indicate some predetermined level of engagement between the container and closure.

Figure 6:
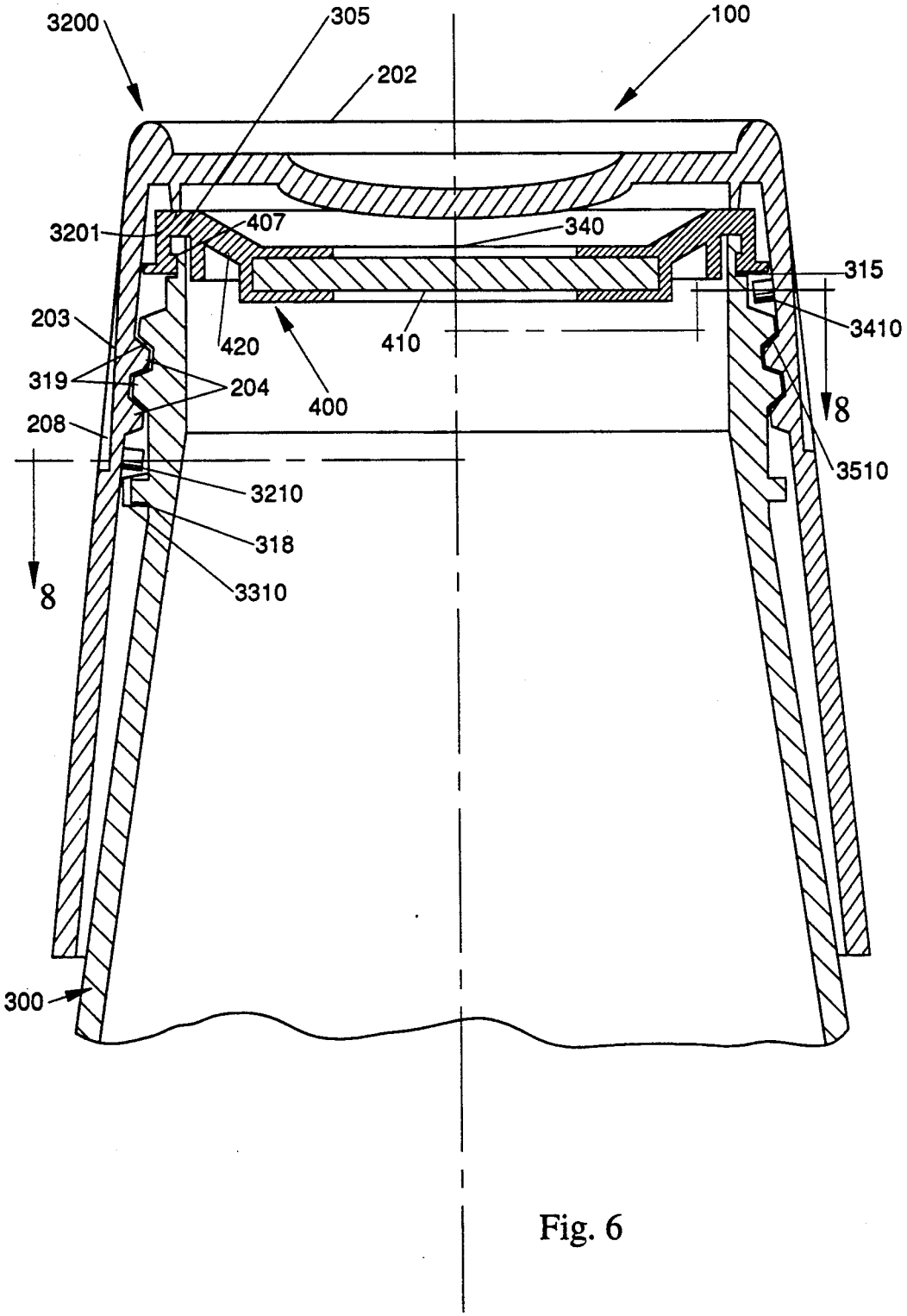
FIG. 6 is an enlarged simplified cross-sectional view of the semi-rigid polymeric container, the polymeric filter support member including the porous filter element mounted therein and the polymeric closure shown in FIG. 1 in an assembled, gas-tight, sealed condition.

In a coffee package of the type disclosed in the aforementioned commonly assigned U.S. patent application Ser. No. 07/358,927, now U.S. Pat. No. 4,966,780, the resealable measuring cup closure 3200 shown in all of the accompanying Drawing Figures is used to establish a substantially gas-tight seal to the atmosphere with the container 300, at least until such time as the package is initially opened by the consumer. While many different structures may be employed to provide such a seal, in the package embodiment shown throughout the accompanying Drawing Figures the resealable closure embodiment 3200 is preferably comprised of a moldable polymeric material and employs a V-shaped sealing member 3201, which is preferably resilient so that it can deform as required to establish a substantially gas-tight initial seal with either the polymeric filter support member 420, as generally shown in FIG. 6, or a reseal which is effective to substantially resist ambient atmospheric pressure changes with the uppermost surface or finish 305 of container 300 when filter support member 420 is not present, as generally shown in FIG. 7.

Figure 2:
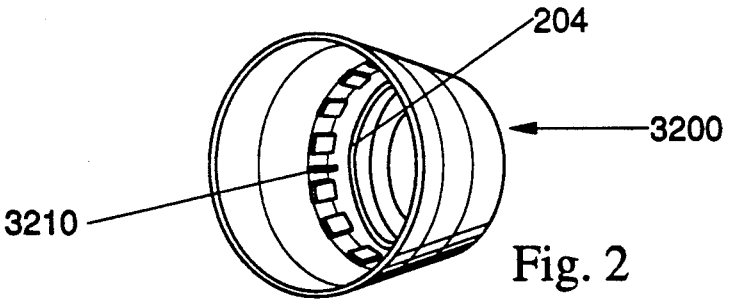
FIG. 2 is a simplified perspective view of the closure member shown in FIG. 1, said closure member being turned on its side to better depict the first resiliently deformable projection employed to produce the audible "click"
Figure 2A:
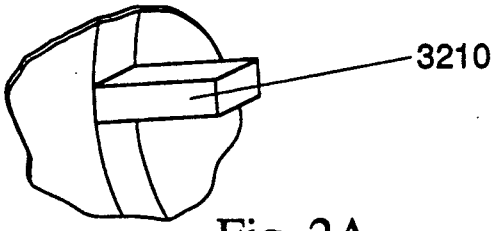
FIG. 2A is a highly enlarged view taken at a point corresponding to inset 2A in FIG. 2 and illustrating the resiliently deformable projection comprising a flapper, which is used to produce an audible "click" after an effective reseal has been established directly between the discharge orifice of the container and the innermost surface of the removable closure.

As can best be seen in FIGS. 2 and 2A, closure member 3200 includes an internal thread 204 which mates with external thread 319 on container 300 and a first inwardly directed resiliently deformable projection comprising a flapper 3210 mounted internally of the closure member. As used herein, the term "thread" shall be broadly defined to include continuous threads, interrupted threads, tapered lugs and other known engaging means which move the closure and container into closer engagement with one another when rotated in one direction and further apart from one another when rotated in the opposite direction.

Figure 3:
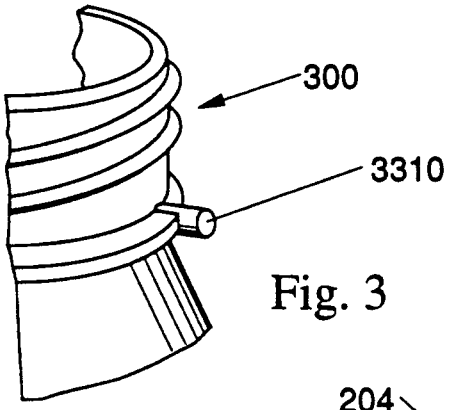
FIG. 3 is a simplified partial perspective view of the polymeric container shown in FIG. 1, said view illustrating an interfering projection comprising a substantially non-deformable post molded into the neck ring of the container.

The support ring 318 on semi-rigid polymeric container 300 is provided with an outwardly projecting substantially non-deformable projection comprising a post 3310, as generally shown in FIG. 3. The inwardly projecting resiliently deformable flapper 3210 on closure member 3200 and the outwardly projecting substantially rigid post 3310 on support ring 318 are vertically positioned relative to one another so that when the sealing member comprising filter support member 420 is present they cannot interfere with one another. This condition is generally shown in FIG. 6, where the closure 3200, the filter 400 comprising filter support member 420 and filter element 410 and the container 300 are assembled in a substantially gas-tight relationship after filling of freshly roasted and ground coffee 500 into the container.

Figure 7:
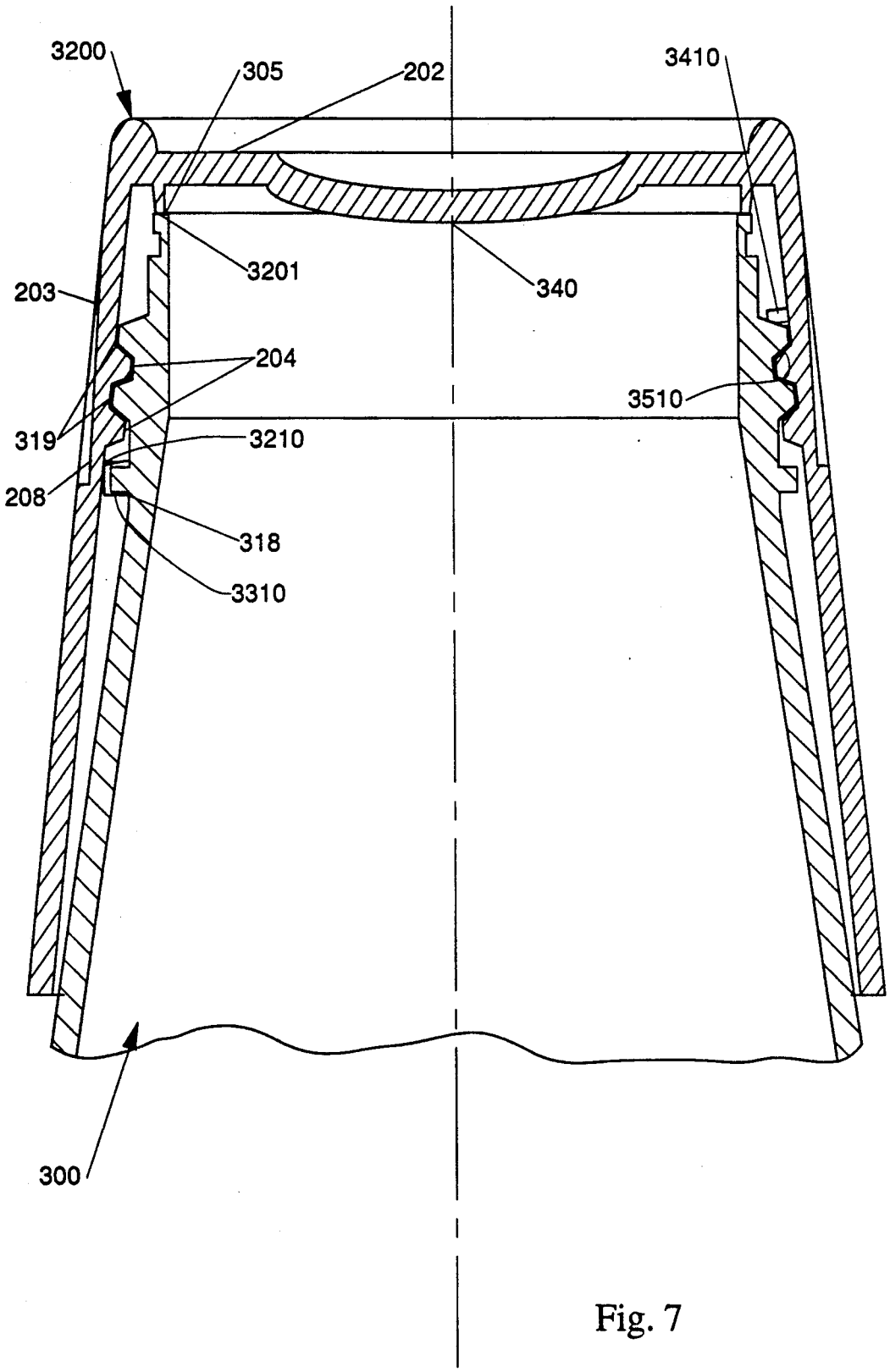
FIG. 7 is a view generally similar to that of FIG. 6, but illustrating the relative positions of the closure and the semi-rigid container after the filter support member containing the porous filter element has been removed and discarded and a reseal which is effective to substantially resist ambient atmospheric pressure changes has been established directly between the innermost surface of the closure and the discharge orifice of the container.
Figure 8A:
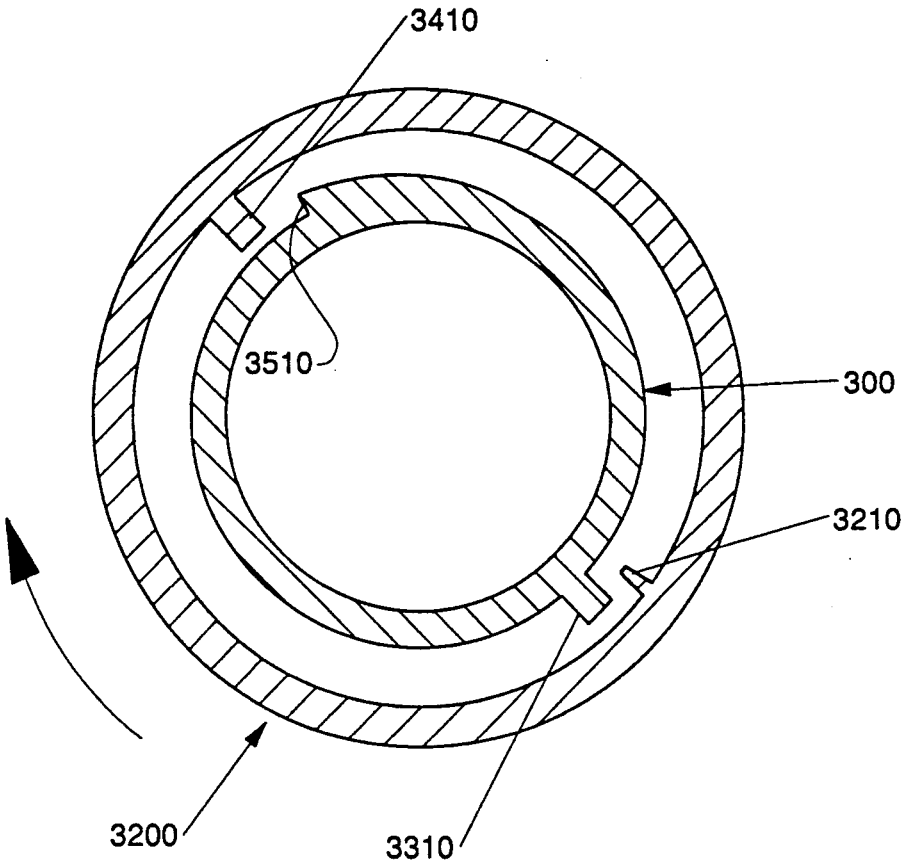
FIG. 8A is a simplified schematic cross-section taken through the closure and the container along a line approximating section line 8—8 of FIG. 6, with the exception that said view is taken after removal of the filter support and filter element at a time just prior to triggering of the audible "click" by the first set of interfering projections.
Figure 8B:
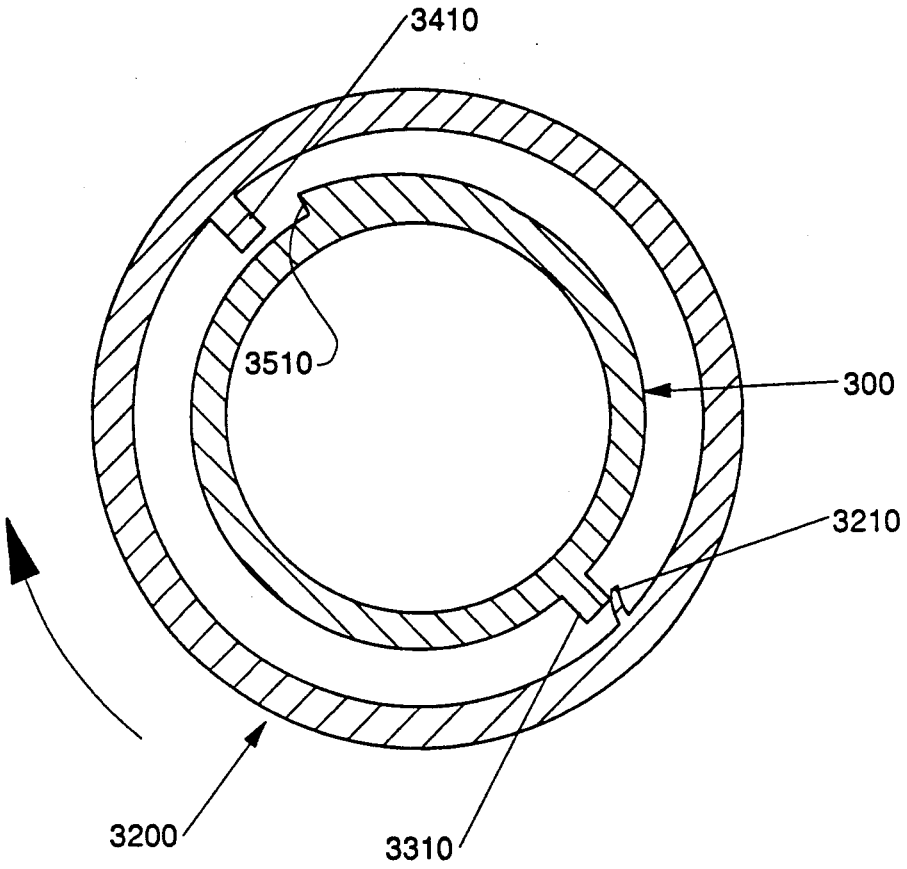
FIG. 8B is a view generally similar to that of FIG. 8A, but illustrating the condition which exists when the first set of interfering projections just begin to contact one another.
Figure 8C:
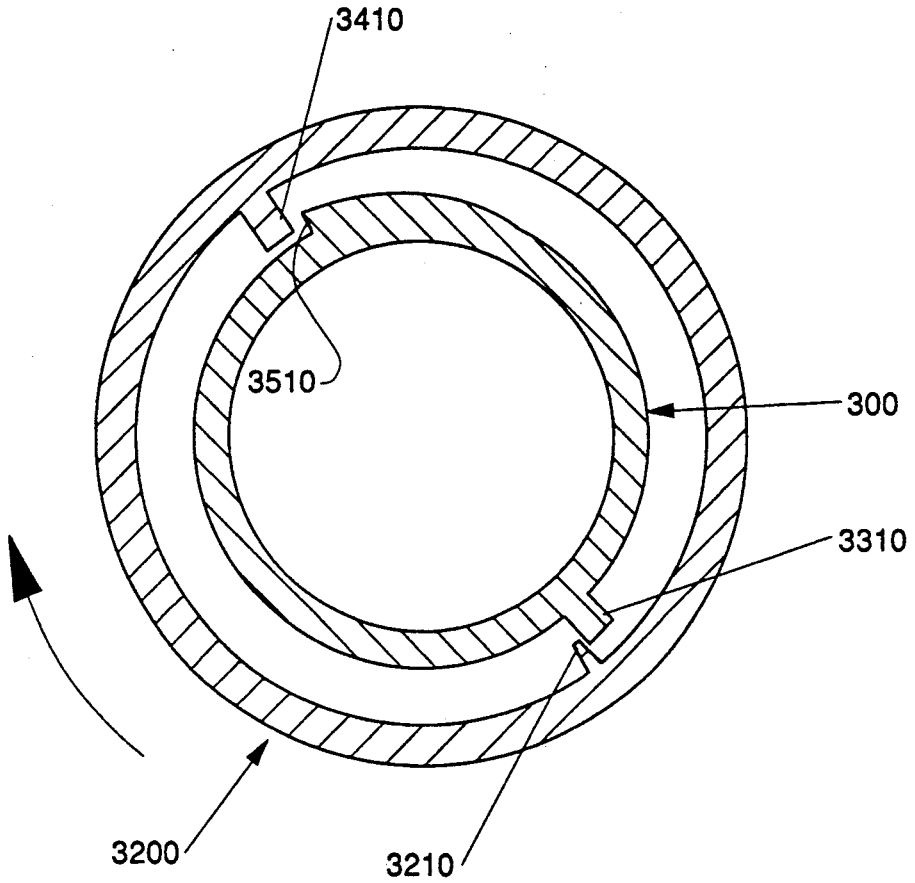
FIG. 8C is a view generally similar to that of FIG. 8B, but illustrating the condition of the first set of interfering projections right after the audible "click" has been sounded by the resiliently deformable flapper on the closure snapping free of the substantially non-deformable post on the container.
Figure 8D:
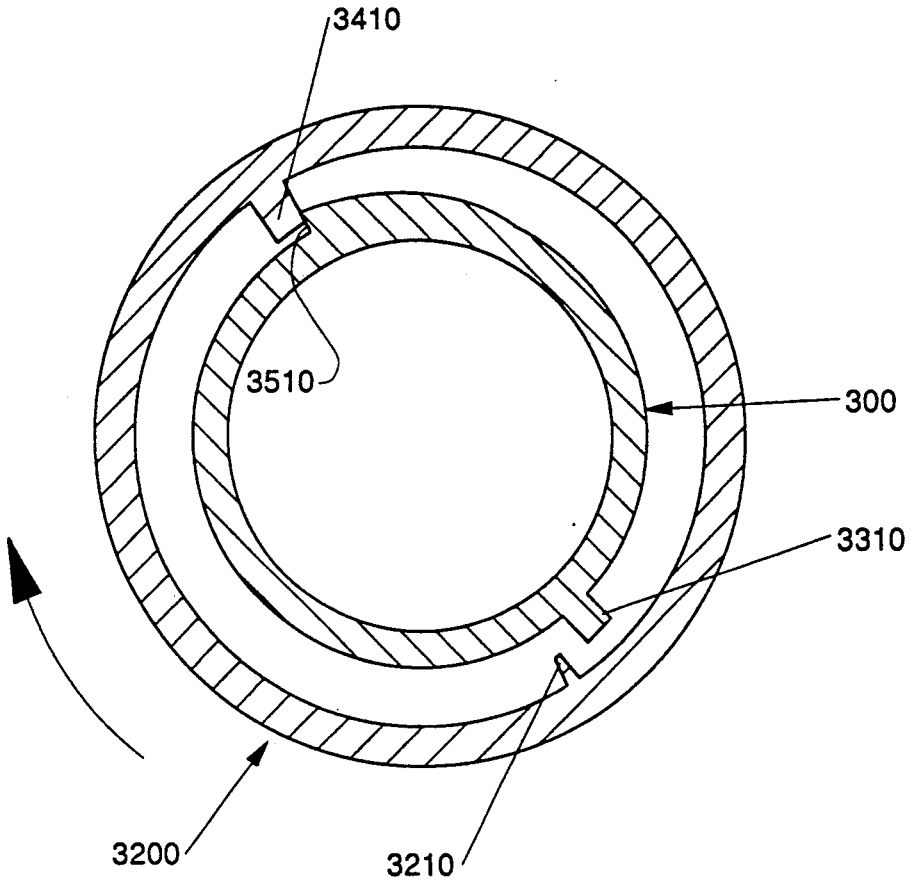
FIG. 8D is a view generally similar to that of FIG. 8C, but illustrating the manner in which the second set of interfering projections comprising the substantially non-deformable post on the closure and the substantially non-deformable squared-off, lead-in portion of the external thread on the container prevent further advancement of the closure onto the container, thereby preventing overtorquing.

However, as can be seen from the cross-section of FIG. 7, which represents the condition existing after the filter 400 has been removed and discarded from the container's discharge orifice 340 and the closure 3200 has been sufficiently re-applied to establish a reseal which will be effective to substantially resist ambient atmospheric pressure changes, the inwardly projecting resilient flapper 3210 and the outwardly projecting substantially rigid post 3310 have been caused to interfere with one another when the internal threads 204 in closure 3200 are screwed far enough onto the mating external threads 319 on container 300.

The sequenced tightening of the closure 3200 onto the container 300 is schematically shown in simplified form in FIGS. 8A through 8D. Passage of resiliently deformable flapper 3210 on closure member 3200 beyond the substantially non-deformable interfering projection 3310 on container 300 produces an audible "click" as the closure passes in a clockwise direction from the position shown in FIG. 8B to the position shown in FIG. 8C.

As will be appreciated by those skilled in the art, the positions of the resiliently deformable flapper 3210 and post 3310 could, with equal facility, be reversed. In such case, the resiliently deformable flapper 3210 would be mounted on container 300 and the post 3310 on closure 3200.

By positioning the interfering projections 3210 and 3310 so that they may contact one another only after an effective reseal has been established between the resiliently deformable V-shaped member 3201 on closure 3200 and the finish 305 of container 300, the audible "click" alerts the user that an effective reseal has been established and that there is no need for further tightening of the closure.

When a molded polymeric closure 3200 measuring approximately 2.00 inches in diameter at its closed end and having a resilient V-shaped sealing member of the type generally illustrated in the accompanying Drawing Figures is threadedly engaged onto a molded semi-rigid polymeric container 300 having a finish 305 measuring approximately 0.0625 inches in width and approximately 1.625 inches in inside diameter, a twisting force of about 15 inch-pounds of torque applied to the closure has normally been found sufficient to provide a reseal which will be effective to substantially resist ambient atmospheric pressure changes.

Figure 4A:
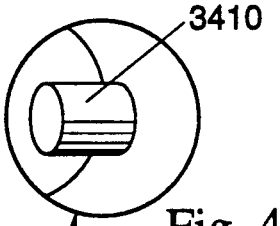
FIG. 4A is a highly enlarged view taken at a point corresponding to inset 4A in FIG. 4 and illustrating the substantially non-deformable post which is used to prevent overtorquing of the closure member onto the container.
Figure 4:
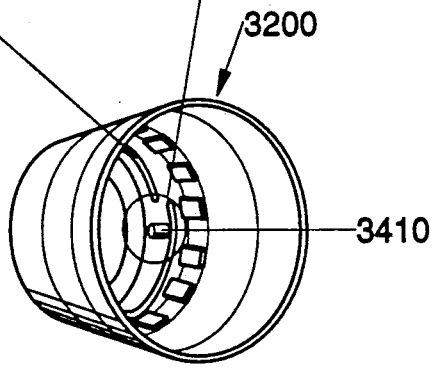
FIG. 4 is another simplified perspective view of the closure shown in FIG. 1, but taken from a different perspective to illustrate a second substantially nondeformable projection used to prevent overtorquing of the closure after the audible "click" has sounded by passage of the first set of interfering projections shown in FIGS. 2, 2A and 3 past one another.

To prevent overtorquing of the closure 3200 onto the container after such an effective reseal has been established, i.e., after the audible "click" has been sounded, the closure 3200 is also preferably provided with a secondary substantially non-deformable internal projection 3410, as generally shown in FIGS. 4 and 4A.

Figure 5:
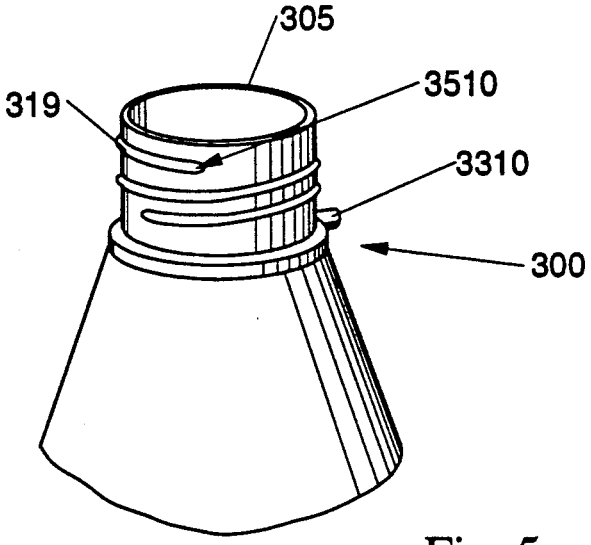
FIG. 5 is a simplified partial perspective view of the finish portion of the semi-rigid polymeric container shown in its entirety in FIG. 1, said view illustrating the substantially non-deformable squared-off, lead-in portion of the external thread which interferes with the substantially non-deformable post shown in FIGS. 4 and 4A and prevents further advancement of the closure onto the container shortly after the audible "click" has been sounded.

Container 300 is also preferably provided with a squared-off portion 3510 at the lead-in end of external thread 319, as generally shown in FIG. 5 for the package embodiment 100 shown in FIG. 1. The vertical positioning of inwardly directed projection 3410 on closure 3200 is such that it cannot make contact with the squared-off portion 3510 of external thread 319 when filter 400 comprising filter support member 420 and filter element 410 is present between the closure and container. This can best be seen in FIG. 6.

However, once the filter 400 has been removed and discarded, the inwardly directed projection 3410 on closure 3200 is caused to align and make contact with the squared-off portion 3510 of external thread 319 on container 300, as generally shown in FIG. 7. Inwardly directed projection 3410 and squared-off portion 3510 of external thread 319 are so positioned relative to interfering projections 3210 and 3310 that interference between the former can only occur after the audible "click" has been sounded by the resilient flapper 3210 on closure 3200 passing beyond the substantially non-deformable post 3310 on neck ring 318 of container 300.

This sequence is likewise shown in the simplified cross-sections of FIGS. 8A through 8D. In particular, contact between internally directed projection 3410 on closure 3200 and the squared-off portion 3510 of external thread 319 on container 300 does not take place until slightly after the audible "click" has been sounded by inwardly extending resiliently deformable flapper 3210 on closure 3200 passing beyond outwardly extending substantially non-deformable post 3310 on container 300.

As will be appreciated by those skilled in the art, other types of interfering structures may be employed on closure 3200 and container 300 with equal facility to prevent overtorquing, e.g., an appropriately positioned substantially non-deformable post may be provided on container 300 in lieu of the squared-off portion 3510 of external thread 319 and the substantially non-deformable post 3410 on closure 3200 may be repositioned so that it can only contact the post on the container after the audible "click" has been sounded by the first set of interfering projections 3210 and 3310.

While particular embodiments of the present invention have been illustrated and described in the context of a freshly roasted and ground coffee package wherein two different levels of sealing are provided at different points in the package's useful life, it will be obvious to those skilled in the art that various changes and modifications can be made without departing from the spirit and scope of the invention.

For example, it may be desirable to provide an audible signal to advise the user that a liquid-tight seal between the container and the closure has been achieved in a liquid mouthwash, soap or shampoo package without the need to further tighten the closure onto the container. This is frequently the situation when the package is being packed into the user's suitcase for travel.

In such instance, there may be no requirement for an independent sealing member between the closure and the container or for a filter across the discharge orifice of the container, since the package is never in a pressurized condition. Furthermore, if an independent sealing member of any type is employed, e.g., for tamper evidence, it may comprise a flexible membrane which is so thin, at least where it contacts the container's finish, that it does not significantly alter the manner in which a seal is established between the closure and the container. In this case it makes no difference whether the membrane is left in place and simply ruptured to access the container's contents or completely stripped away and discarded by the user to expose the entire finish of the container.

Figure 9:
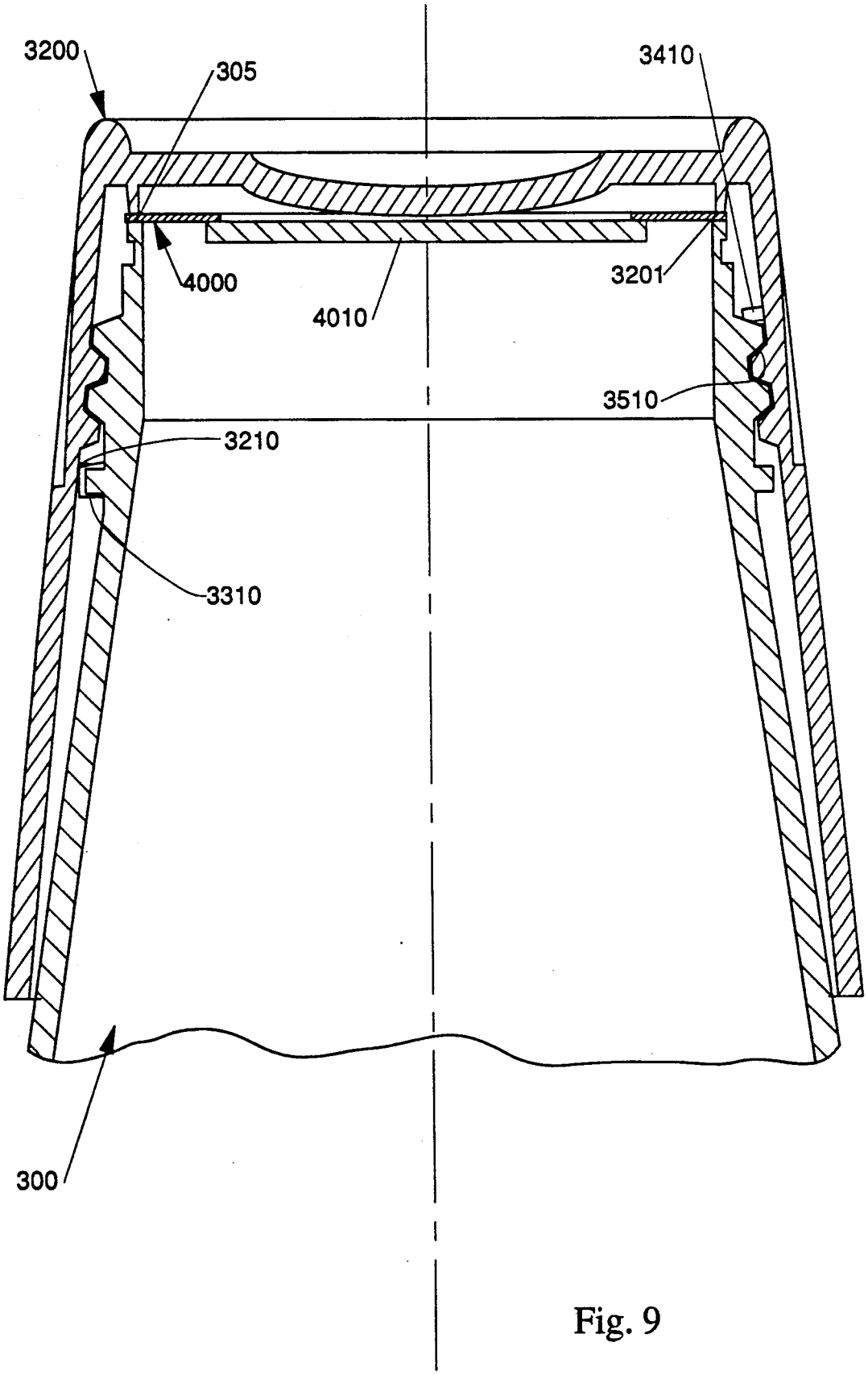
FIG. 9 is an enlarged simplified cross-sectional view of an alternative package of the present invention which may be generally similar to that of FIG. 6, but which employs a thin flexible membrane including a centrally located porous filter sealed to the finish of the container in lieu of the polymeric insert shown in FIG. 6.

Such an embodiment is illustrated schematically in FIG. 9, wherein a flexible membrane 4000 is shown sealed to the finish 305 of container 300. In the case of a fresh roasted coffee package of the type generally disclosed in the commonly assigned U.S. patent application Ser. No. 07/358,927, now U.S. Pat. No. 4,966,780, which is incorporated herein by reference, the central portion of membrane 4000 may be provided with a porous filter element 4010 to permit pressure equalization upon initial opening of the pressurized package without aspiration of the coffee from the container.

After initial opening, the central portion of the membrane 4000 may be ruptured and the balance of the membrane left in place prior to reapplying the closure 3200. In this event, the reseal is established in exactly the same manner as the initial seal.

Alternatively, the thin membrane 4000 may be completely stripped from the container's finish 305 prior to reapplying the closure 3200. Since the membrane 4000 is so thin, its complete removal does not significantly impact upon either the manner or the rotational position at which the reseal directly between the closure and the container is established. Accordingly, both sets of interfering projections function in substantially the same way as if the membrane were still present.

It is intended to cover in the appended claims all such modifications which fall within the spirit and scope of the present invention.

What is claimed is:

1. In combination, a container having a discharge orifice defined by an externally threaded finish portion of said container and a removable internally threaded closure including an open end to permit threadedly engaging said closure on said externally threaded finish portion of said container and a closed end for sealing said discharge orifice, at least one of said container and said closure having a first resiliently deformable projection which will interfere with a second substantially non-deformable projection on the other of said container and said closure as it passes by said second substantially non-deformable projection to produce an audible signal, said first and second interfering projections being positioned so that they cannot contact one another as said closure is threadedly advanced onto said container until said discharge orifice in said container has been sealed by said closed end of said closure, said combination also including a sealing member located between said discharge orifice of said container and said closed end of said closure, whereby said discharge orifice forms a seal with a first surface of said sealing member and said closed end of said closure forms a seal with a second surface of said sealing member positioned opposite said first surface, said sealing member also including means for supporting a porous filter element, said combination further including a gas evolving granular product housed within said container and wherein a substantially gas-tight seal to the atmosphere is initially established between said closure, said sealing member and said discharge orifice of said container, whereby said container is pressurized by the gas evolving from said granular product relative to the surrounding atmosphere prior to initial opening, and whereby said porous filter element supported by said sealing member will prevent said granular product from aspirating through said discharge orifice of said container upon initial removal of said closure from said container, said sealing member being removed and discarded after initial opening, whereupon a reseal which will be effective to substantially resist ambient atmospheric pressure changes will be established directly between said closure and said container each time said closure is reapplied and said audible signal sounds.

2. The combination of claim 1, wherein said sealing member comprises a molded polymeric fitment which supports a centrally located porous filter element.

3. The combination of claim 1, wherein said sealing member comprises a thin rupturable or removable membrane which supports a centrally located porous filter element across the discharge orifice of said container.

4. The combination of claim 3, wherein said membrane comprises metallic foil and wherein said membrane is secured across the discharge orifice of said container prior to initially applying said closure.

5. In combination, a molded polymeric container having a discharge orifice defined by an externally threaded finish portion of said container and a removable internally threaded molded polymeric closure including an open end to permit threadedly engaging said closure on said externally threaded finish portion of said container and a closed end for sealing said discharge orifice, at least one of said container and said closure having a first resiliently deformable projection which will interfere with a second substantially non-deformable projection on the other of said container and said closure as it passes by said second substantially non-deformable projection to produce an audible signal, said first and second interfering projections being positioned so that they cannot contact one another as said closure is threadedly advanced onto said container until said discharge orifice in said container has been sealed by said closed end of said closure, said combination further including a third substantially non-deformable projection on said closure and a fourth substantially non-deformable interfering projection on said container, said third and fourth projections being positioned so that they will not contact one another as said closure is threadedly advanced onto said container until after said audible signal has been sounded by said first resiliently deformable projection passing by said second substantially non-deformable projection, whereby said closure is prevented from being overtorqued onto said container by the interference which occurs between said third and fourth projections, said combination also including a sealing member located between said discharge orifice of said container and said closed end of said closure, whereby said discharge orifice forms a seal with a first surface of said sealing member and said closed end of said closure forms a seal with a second surface of said sealing member positioned opposite said first surface, said sealing member also including means for supporting a porous filter element, said combination further including a gas evolving granular product housed within said container and wherein a substantially gas-tight seal to the atmosphere is initially established between said closure, said sealing member and said discharge orifice of said container, whereby said container is pressurized by the gas evolving from said granular product relative to the surrounding atmosphere prior to initial opening, and whereby said porous filter element supported by said sealing member will prevent said granular product from aspirating through said discharge orifice of said container upon initial removal of said closure from said container, said sealing member being removed and discarded after initial opening, whereupon a reseal which will be effective to substantially resist ambient atmospheric pressure changes will be established directly between said closure and said container each time said closure is reapplied and said audible signal sounds.

6. The combination of claim 5, wherein said sealing member comprises a molded polymeric fitment which supports a centrally located porous filter element.

7. The combination of claim 5, wherein said sealing member comprises a thin rupturable or removable membrane which supports a centrally located porous filter element across the discharge orifice of said container.

8. The combination of claim 7, wherein said membrane comprises metallic foil and wherein said membrane is fused across the discharge orifice of said polymeric container prior to initially applying said closure.

* * * * *